US010174536B2

(12) United States Patent
Krumbiegel et al.

(10) Patent No.: US 10,174,536 B2
(45) Date of Patent: Jan. 8, 2019

(54) DOOR HINGE

(71) Applicant: INNOMOTIVE SYSTEMS HAINICHEN GMBH, Hainichen (DE)

(72) Inventors: Ulrich Krumbiegel, Striegistal (DE); Martin Porstmann, Chemnitz (DE)

(73) Assignee: INNOMOTIVE SYSTEMS HAINICHEN GMBH, Hainichen (DE)

( * ) Notice: Subject to any disclaimer, the term of this patent is extended or adjusted under 35 U.S.C. 154(b) by 0 days.

(21) Appl. No.: 15/827,552

(22) Filed: Nov. 30, 2017

(65) Prior Publication Data

US 2018/0155970 A1 Jun. 7, 2018

(30) Foreign Application Priority Data

Dec. 5, 2016 (EP) ..... 16002583

(51) Int. Cl.

| | |
|---|---|
| ***E05D 11/08*** | (2006.01) |
| ***E05D 11/10*** | (2006.01) |
| ***E05D 11/06*** | (2006.01) |
| ***E05D 5/06*** | (2006.01) |

(52) U.S. Cl.

CPC ..... *E05D 11/1057* (2013.01); *E05D 5/062* (2013.01); *E05D 11/06* (2013.01); *E05D 11/087* (2013.01); *E05D 11/1085* (2013.01); *E05Y 2900/531* (2013.01)

(58) Field of Classification Search

CPC ..... Y10T 16/5403; Y10T 16/54033; Y10T 16/54034; Y10T 16/540345; Y10T 16/54028; Y10T 16/54029; E05D 11/1057; E05D 11/06; E05D 11/08; E05D 11/087; E05D 2011/1035

See application file for complete search history.

(56) References Cited

U.S. PATENT DOCUMENTS

| | | | | |
|---|---|---|---|---|
| 2,608,713 | A * | 9/1952 | Soss | E05D 3/186 16/337 |
| 6,073,308 | A * | 6/2000 | Linnenbrink | E05D 11/1071 16/263 |
| 6,282,752 | B1 | 9/2001 | Kluting et al. | |
| 6,684,455 | B1 | 2/2004 | Mertin | |
| 7,203,996 | B2 * | 4/2007 | Linnenbrink | E05D 11/1071 16/334 |

(Continued)

FOREIGN PATENT DOCUMENTS

| | | |
|---|---|---|
| BE | 400951 | 1/1934 |
| DE | 4207706 A1 | 9/1993 |

(Continued)

*Primary Examiner* — Chuck Y Mah

(74) *Attorney, Agent, or Firm* — Hudak, Shunk & Farine, Co., LPA

(57) ABSTRACT

A door hinge with at least one hinge axis, at least one holding arm that engages on the hinge axis and at least one contour, in which the at least one holding arm is supported on the contour with at least one section, retaining disks are arranged adjacent to the at least one holding arm and brake disks are arranged adjacent to the contour in order to generate a holding torque that is dependent on the opening angle, wherein the retaining disks and the brake disks engage into one another, and wherein at least the first holding arm, which is supported on the contour, is or can be stressed at least relative to the contour by a basic clamping force.

19 Claims, 2 Drawing Sheets

(56) References Cited

U.S. PATENT DOCUMENTS

| | | | | |
|---|---|---|---|---|
| 2001/0025397 | A1* | 10/2001 | Audisio | E05D 11/1085 16/334 |
| 2002/0023313 | A1* | 2/2002 | Parizel | E05D 11/1071 16/318 |
| 2003/0093873 | A1* | 5/2003 | Linnenbrink | E05D 11/081 16/85 |
| 2003/0140455 | A1* | 7/2003 | Audisio | E05C 21/005 16/334 |
| 2004/0187260 | A1* | 9/2004 | Bruckner | E05D 11/1085 16/334 |
| 2005/0066475 | A1 | 3/2005 | Minami | |
| 2006/0168757 | A1* | 8/2006 | Duning | E05D 11/1085 16/49 |
| 2007/0050940 | A1* | 3/2007 | Lowen | E05D 11/1071 16/334 |
| 2012/0233814 | A1* | 9/2012 | Minegishi | E05D 11/1057 16/332 |
| 2012/0246875 | A1* | 10/2012 | Lowen | E05D 11/1071 16/337 |
| 2012/0317751 | A1* | 12/2012 | Nagami | E05D 11/1028 16/328 |

FOREIGN PATENT DOCUMENTS

| | | | |
|---|---|---|---|
| DE | 4212181 | A1 | 10/1993 |
| DE | 29611674 | U1 | 10/1996 |
| EP | 1144786 | B1 | 4/2004 |
| EP | 2568103 | A1 | 3/2013 |
| NL | 6612273 | | 1/1968 |

* cited by examiner

DOOR HINGE

FIELD OF INVENTION

The invention relates to a door hinge for connecting and pivoting a door relative to a column console, wherein said door hinge comprises at least one hinge axis, at least one holding arm that engages on the hinge axis and at least one contour, and wherein the at least one holding arm is supported on the contour with at least one section, as well as to a vehicle with at least one such door hinge.

BACKGROUND OF THE INVENTION

Various designs of door hinges, particularly for the automotive industry, are known from the prior art. They serve for pivotably connecting a vehicle door to a vehicle body. In this context, it is particularly known to hold the vehicle door in a desired open position or a desired closed position relative to the vehicle body by means of a stop mechanism without requiring additional locking means.

For example, EP 2 568 103 B1 discloses a motor vehicle door hinge with a column console that is arranged on a vehicle body, a door console that can be connected to a motor vehicle door, a hinge pin that pivotably connects the door console and the column console and is non-rotatably connected to the column console, as well as pivotably connected to the door console, and a stop mechanism, wherein the stop mechanism comprises a brake insert that is non-rotatably connected to the door console and features a braking surface, as well as a stopping element that is non-rotatably connected to the hinge pin and features adjustable retaining surfaces in the direction of the braking surface. The retaining surfaces are arranged on two stopping element arms that are realized integrally with the stopping element and can be elastically displaced in the direction of the braking surface by means of an adjusting unit in such a way that the retaining surfaces rest against the braking surface. The brake insert is arranged between the two stopping element arms that respectively feature the retaining surfaces. The adjusting unit is designed in such a way that it presses the retaining surfaces against opposing braking surfaces of the brake insert, wherein the adjusting unit features a set screw, by means of which the stopping element arms can be displaced in the direction of the brake insert. In this case, the set screw extends between the stopping element arms in such a way that the distance between the stopping element arms can be adjusted with the set screw. The brake insert furthermore features contoured braking surfaces, i.e. the braking surfaces feature depressions and elevations relative to a principal plane of the braking surfaces, wherein a higher holding torque is generated in the region of the elevations and a holding torque, which is reduced in comparison with the principal plane, is generated in the region of the depressions.

EP 1 144 786 B1 discloses another pivot joint in the form of a door hinge, in which a device for locking a first motion element such as a door part on a second motion element such as a column part is movably coupled to the door hinge. A locking unit featuring a first and a second braking element is furthermore provided, wherein the first braking element consists, e.g., of outer disks and the second braking element consists, e.g., of inner disks. The first braking element is connected to the first motion element and the second braking element is connected to the second motion element. The braking elements can be engaged with one another under the influence of a force generated by a force application element in such a way that they are locked on one another, wherein the motion elements are likewise locked on one another in this case due to the connections between the braking elements and the motion elements. The force application element is realized, e.g., in the form of a spring. A mechanical switching unit is furthermore provided and can assume a coupled state and a separated state, wherein the switching unit changes over from the coupled state into the separated state when the motion elements are moved relative to one another and releases the force acting upon the braking elements in the coupled state such that these braking elements are engaged with one another. The switching unit furthermore comprises a first or a second actuating element, wherein the first actuating element is connected to the first motion element and the second actuating element is connected to the second motion element. The connection is respectively realized in such a way that the movement of the motion elements causes a rotational motion of the actuating elements, which are arranged on one another in such a way that they carry out a pivoting motion parallel to the rotational axis during a mutual change of position. The actuating elements thereby change their distance from one another such that the switching unit changes over from the coupled state into the separated state, in which the force acting upon the braking elements is blocked such that the braking elements are separated from one another. A coupling element, e.g. in the form of balls, is furthermore provided and converts the relative movement between the motion elements into a pivoting movement of the actuating elements, wherein the coupling element automatically returns into its starting position and thereby releases the force acting upon the braking elements such that the braking elements are engaged with one another.

BE 400 951 A discloses a decelerating device for a door closer system. In this case, friction disks are provided and displaceably arranged on an axis. The friction disks form two alternating groups, one of which is connected to the axis in a rotationally rigid fashion due to a cam and the other one of which is unable to turn about the body of the door hinge.

DE 42 12 181 A1 discloses a hinge with a stop mechanism and with spring-loaded stopping elements that are equipped with cam tracks and can be axially moved relative to a hinge pin. Frictional engagement elements are assigned to the stopping elements and connected to the hinge halves in a rotationally rigid fashion, as well as axially movable relative to the hinge pin, wherein the spring elements, stopping elements and frictional engagement elements are arranged within a closed hollow space formed by the two hinge halves.

Furthermore, special designs of the door stopping mechanisms are respectively known from DE 296 11 674 U1 and DE 42 07 706 A1, a tilt hinge is known from US 2005/0066475 A1 and an adapter for a connecting hinge of a tripod comprising torque disks is known from NL 6 612 273 A.

SUMMARY OF THE INVENTION

The present invention is based on the objective of enhancing a door hinge, particularly a motor vehicle door hinge for being connected to a door that can be pivoted relative to a column console, comprising at least one hinge axis, at least one holding arm that engages on the hinge axis and at least one contour, wherein the at least one holding arm is supported on the contour with at least one section, in such a way that a varying holding torque, which is dependent on the opening angle of the door, can be generated with less wear of the door hinge than in the solutions known from the prior art.

In a hinge for being connected to a door that can be pivoted relative to a column console, comprising at least one hinge axis, at least one holding arm that engages on the hinge axis and at least one contour, wherein the at least one holding arm is supported on the contour with at least one section, this objective is attained in that retaining disks are arranged adjacent to the at least one holding arm and brake disks are arranged adjacent to the contour in order to generate a holding torque that is dependent on the opening angle of the door, which is or can be connected to the door hinge (100), during a pivoting movement thereof, wherein the retaining disks and the brake disks engage into one another, the at least one contour is formed on the outer side of at least one contour element, the brake disks and the contour element have the shape of a circular arc and the at least one holding arm and the retaining disks are non-rotatably held on the hinge axis, wherein the assembly consisting of the contour element with its contour and the brake disks can be moved relative to the assembly consisting of the at least one holding arm and the retaining disks about the hinge axis, and wherein at least the first holding arm, which is supported on the contour, is or can be stressed at least relative to the contour by means of a basic clamping force in order to hold the assemblies consisting of the holding arms and retaining disks and of the contour element and the brake disks on one another. Enhancements of the invention are defined in the dependent claims.

Consequently, a thusly designed door hinge comprises at least one hinge axis, on which at least one holding arm engages. The at least one holding arm particularly is arranged on the hinge axis such that it extends transverse thereto, particularly perpendicular thereto. For example, the at least one holding arm has an end that is provided with a through-opening, wherein the hinge axis extends through this through-opening after the installation of the at least one holding arm on the hinge axis. The hinge axis may particularly be arranged in a space with a vertical orientation and the at least one holding arm arranged thereon may extend away from the hinge axis in said space perpendicular thereto, particularly with an approximately horizontal orientation. The at least one holding arm advantageously is non-rotatably arranged on the hinge axis in order to prevent the at least one holding arm from inadvertently rotating or turning about the hinge axis. This can be realized, in particular, with uneven shapes of the through-opening and the hinge axis at least in the region, in which the at least one holding arm is arranged on the hinge axis.

Retaining disks are arranged adjacent to the at least one holding arm, wherein said retaining disks are in an arrangement of two holding arms preferably arranged between the holding arms. The retaining disks are also fixed on the hinge axis on one side like the holding arm and particularly feature a through-opening on one end, by means of which they can be connected to the hinge axis. With respect to the retaining disks, it is advantageous to non-rotatably arrange the retaining disks on the hinge axis. In this way, it can be ensured that the retaining disks and the holding arms are adjacently arranged on the hinge axis in alignment with one another, particularly underneath one another if the hinge axis is vertically arranged in space.

The at least one holding arm engages on the contour, wherein at least the first holding arm, namely the top holding arm in a vertical arrangement of the hinge axis in a space, engages on the contour, e.g., if two holding arms are provided. If two holding arms are provided, the contour is arranged between the two holding arms. The contour is particularly formed on the outer side of a contour element. Brake disks are arranged adjacent to the contour. These brake disks advantageously have an external shape that corresponds to the contour element, but usually an outer contour that does not correspond to the contour. In fact, the brake disks are typically designed in a flat or planar fashion just like the retaining disks. In a vertical arrangement of the contour element and the brake disks (in a space), the contour of the contour element is arranged on the very top whereas the brake disks are arranged thereunder. The retaining disks and the brake disks respectively engage into one another or mesh with one another. The retaining disks and the brake disks particularly engage into one another alternately. If two holding arms are provided, for example, at least one section of the at least one first holding arm is supported on the contour. In this case, the at least one second holding arm can engage underneath the brake disk that is spaced apart from the contour by the greatest distance, particularly the bottom brake disk (in a vertical arrangement in space), or underneath the bottom retaining disk that is spaced apart from the contour by the greatest distance. It is furthermore conceivable to provide only one holding arm that exerts pressure upon the retaining disks and the brake disks via the contour of the contour element, wherein the retaining disk or brake disk, which is spaced apart from the holding arm by the greatest distance, is supported on the lower part of a housing of the door hinge, in which these disks are accommodated. If only one holding arm is provided, this holding arm therefore exerts pressure upon the retaining disks and the brake disks via the contour of the contour element. The bottom or last retaining disk or brake disk, i.e. the retaining disk or brake disk that is spaced apart from the holding arm by the greatest distance depending on which disk forms the bottom or last disk, is pressed against the lower part, e.g. a bottom, of the housing accommodating the door hinge by the pressure exerted upon the holding arm.

When a door connected to the door hinge is moved, i.e. opened or closed, the assembly consisting of the contour or the contour element and the brake disks is moved relative to the assembly consisting of the at least one holding arm and the retaining disks. The at least one holding arm or, in the case of more than one holding arm, the first holding arm is pressed against the contour by a basic clamping force. This makes it possible for the holding arm or the first holding arm to follow the contour during its movement while it, i.e. the holding arm or the first holding arm, passes over the contour.

The contour particularly has a flat or planar surface, but also features elevations relative thereto. Furthermore, depressions may likewise be provided. When the first holding arm passes over the elevations of the contour, the holding arm or the first holding arm is acted upon with a clamping force that is greater than the basic clamping force whereas the holding arm or the first holding arm is acted upon with a clamping force that is lower than the basic clamping force when it passes over the depressions. The clamping force is advantageously identical to the basic clamping force in the region of the planar surface of the contour.

For example, at least one spring assembly such as a disk spring assembly is provided for generating the basic clamping force. This spring assembly engages on the first holding arm and presses this holding arm against the contour with the basic clamping force.

A device other than a spring assembly or disk spring assembly may also be provided for generating the basic clamping force, for example a pneumatic device that likewise generates the desired basic clamping force for pressing the holding arm(s), the contour, the retaining disks and the brake disks against one another. Apart from at least one pneumatic device, at least one hydraulic and/or electric device, particularly a pneumatic and/or hydraulic and/or electric drive, may be provided for generating the basic clamping force.

It is furthermore advantageous to form the at least one contour on the outer side of at least one contour element that has the shape of a circular arc, i.e. the contour element forms a circular arc element. This allows a space-saving design, in which the contour element and the brake disks respectively have the shape of a circular arc. In this case, the holding arm or the first holding arm can continuously slide on the contour formed or arranged on the outer side of the circular arc element. Due to the elevations, the planar surface and, if applicable, the depressions in the contour of the circular arc element, the spring assembly is compressed to different degrees while the holding arm or the first holding arm passes over the contour. This also changes the resulting clamping force, which acts upon and presses the retaining disks and the brake disks meshing therewith against one another.

A holding torque is generated due to the clamping force, which the holding arms and retaining disks exert upon the contour and the brake disks. The holding torque changes in accordance with the design of the contour while pivoting the door, which is or can be connected to the door hinge, namely in dependence on the opening angle of the door or in dependence on the position of the holding arm or the first holding arm on the contour of the respective contour element or circular arc element. Depending on the contour, the variation of the clamping force accordingly makes it possible, for example, to form a free-running region, in which a low clamping force or no clamping force and therefore a low holding torque or no holding torque is generated while the holding arm or the first holding arm passes over a depression, and/or at least one retaining region, in which a high clamping force and therefore a high holding torque is generated while the holding arm or the first holding arm passes over an elevation, and/or at least one comfort region, in which a comparatively average clamping force and therefore a holding torque that lies between a high and a low holding torque is generated while the holding arm or the first holding arm passes over a planar surface or over an elevation, which is lower than the elevation at which a high holding torque is generated, and/or at least one damping region, in which the clamping force and therefore also the holding torque continuously increases before a final position is reached while the holding arm or the first holding arm passes over an upwardly extending ramp. A free-running region may be provided for closing the door, a retaining region may be provided for securely holding the door on a hill and a comfort region may be provided for holding the door on level ground. Depending on the respective design of the contour, it is therefore possible to achieve haptics of the door hinge, which are respectively changed by or dependent on the opening angle of the door.

The brake disks are advantageously shaped in accordance with the curvature of the circular arc-shaped contour element or circular arc element and arranged parallel to and in alignment with the at least one circular arc-shaped contour element or circular arc element. This results in a unit consisting of the circular arc-shaped contour element or circular arc element with its outer contour and the brake disks, which are arranged on the side of the circular arc-shaped contour element or circular arc element lying opposite of the contour, i.e. in a compact assembly of sorts.

At least one adjusting device may be provided for adjusting the basic clamping force. If a disk spring assembly is provided, it would be conceivable to provide at least one set screw that acts upon the disk spring assembly. Such an adjusting device makes it possible to specifically adjust the basic clamping force, i.e. the clamping force exerted by the assembly consisting of the at least one holding arm and the retaining disks arranged parallel thereto upon the assembly consisting of the contour element with the outer contour and the brake disks, for the respective application. In order to achieve an optimal clamping effect for these components of the door hinge, the device exerting the basic clamping force, particularly the spring assembly or disk spring assembly and the set screw, is arranged as close as possible to the contact region between the holding arm(s) and the retaining disks and the contour of the contour element, particularly the circular arc element, and the brake disks.

The at least one holding arm and the retaining disks are advantageously mounted on the hinge axis such that they can be axially displaced along the hinge axis. This makes it possible to achieve a suitable positioning on the hinge axis, which is specific to the respective application. It is furthermore advantageous if the at least one holding arm rests on the adjacent retaining disk, i.e. the top retaining disk in a vertical arrangement of the hinge axis in space, with a spherical surface or a spherical section. In this way, the retaining disk assembly can be depressed by the at least one holding arm and, if at least two holding arms are provided, held between the at least two holding arms in order to form a compact unit consisting of at least two holding arms with retaining disks arranged in between and to accommodate and retain the components of the contour element with its outer contour and the brake disks, which are arranged between the retaining disks, between one another in a clamping fashion.

The at least one contour element provided with the contour, particularly the at least one circular arc element, and the brake disks may be mounted in a housing of the door hinge in an axially displaceable fashion. This allows optimal positioning of the contour element and the brake disks on the door hinge and optimal positioning relative to the at least one holding arm and the retaining disks specific to the respective application. The contour element, particularly the circular arc-shaped contour element or circular arc element, and the brake disks particularly may be held on one another by means of pin elements, wherein the circular arc element and the brake disks are mounted such that they can be axially displaced along the pin elements. Furthermore, disk springs may be advantageously arranged between the brake disks in order to position the brake disks free of play. This makes it possible to prevent annoying noises while the door is pivoted about the door hinge and to compensate the wear of the brake disks and/or the contour element or its outer contour occurring over the service life of the door hinge.

It is furthermore advantageous if at least the surfaces or surface sections of the holding arm/holding arms, which rests against one another and/or slide on one another, the retaining disks and the brake disks, as well as the contour of the contour element, particularly the circular arc element, are provided with at least one coating and/or heat-treated in order to influence their sliding properties and/or wear behavior. Due to such a coating and/or heat treatment of at least the respective surfaces of the door hinge components that slide on one another, i.e. the at least one holding arm, the contour of the contour element, the retaining disks and the brake disks, the sliding movement of these surfaces on one another can be simplified and the surfaces can be protected against wear. In this way, the service life of the door hinge can be prolonged in comparison with uncoated components that slide on one another.

It is preferred to provide a plurality of retaining disks and a plurality of brake disks that are engaged with one another. The utilization of multiple retaining disks and brake disks makes it possible to significantly lower the clamping force generated by a required holding torque. Since the resulting stress is lower than in the solutions known from the prior art, the wear is particularly reduced between the holding arm or the first holding arm and the contour, on which this holding arms slides.

The door hinge has a modular design due to the at least one holding arm with the retaining disks arranged adjacent thereto, the contour element with the outer contour and the brake disks. All these components of the door hinge are variable, i.e. no definitive units are provided. This modular design of the door hinge makes it possible to easily change the properties of the door hinge, for example, by changing the contour or changing the number of retaining disks and/or brake disks.

Due to the circular arc-shaped design of the contour element with its outer contour and the brake disks, the structural size of the door hinge can be kept small and the available structural space in the region of a vehicle door and a vehicle column, on which the vehicle door is mounted, can be optimally utilized. Furthermore, a very small distance between the door axis and the outer shell of the vehicle door or the vehicle can be realized by providing a clearance between the hinge axis and the vehicle column.

The retaining disks and/or the brake disks may be axially arranged on the hinge axis, i.e. on top of one another. It is likewise possible to arrange the brake disks and/or the retaining disks, e.g., radially with respect to the orientation of the hinge axis of the door hinge.

Instead of providing only one holding arm or two holding arms, i.e. a pair of holding arms that extend approximately parallel to one another along the hinge axis, it is likewise possible to provide multiple holding arms or pairs of holding arms and/or a pair of holding arms arranged in the shape of a star or a star-shaped holding arm arrangement, respectively. In this case, the retaining disks that respectively engage or mesh with the brake disks in order to generate the desired clamping force and therefore the retired holding torque for a door connected to the door hinge are still arranged between the holding arms of the respective pair.

BRIEF DESCRIPTION OF THE DRAWINGS

An exemplary embodiment of the invention is described in greater detail below with reference to the drawings. In these drawings.

DETAILED DESCRIPTION OF THE INVENTION

Figure 1:
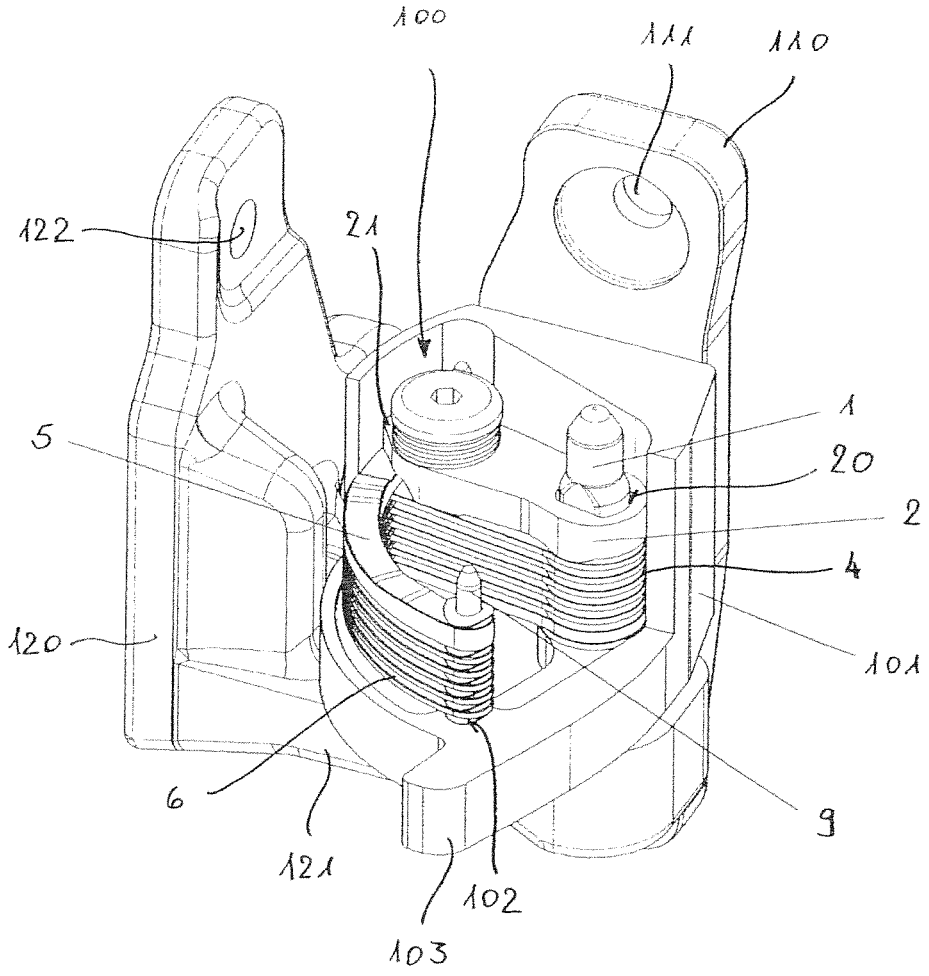
FIG. 1 shows a perspective view of an embodiment of an inventive door hinge, which is accommodated between a column console for being mounted on a vehicle body and a door console for being mounted on a vehicle door.

FIG. 1 shows an installed state of a door hinge 100 that is accommodated in a housing 101. A door console 110 for being mounted on a not-shown door is arranged adjacent to one side of the housing 101. In order to mount the door on the door console 110, the latter features at least one mounting opening 111, into which a bolt, a screw or another fastening means can engage.

A mounting arm 121 of a column console 120 engages underneath the door hinge 100, which in the installed state according to FIG. 1 is arranged approximately vertical (in space), and supports this door hinge. The column console 120 serves for mounting the door hinge 100 on a vehicle body that is not illustrated in FIG. 1. The column console 120 features at least one mounting opening 122, into which a bolt, a screw or another fastening mean can engage, in order to be mounted on the vehicle body. The mounting arm 121 protrudes approximately perpendicular from the column console 120 and features an opening or a bearing for supporting a hinge axis 1 of the door hinge 100. A bearing pin 11 arranged on the lower end 10 of the hinge axis 1 (see FIG. 2) serves for supporting the mounting arm 121 of the column console 120 in the opening or the bearing provided at this location. The hinge axis 1 of the door hinge 100 is therefore rotatably supported on the mounting arm 121 of the column console 120.

Figure 2:
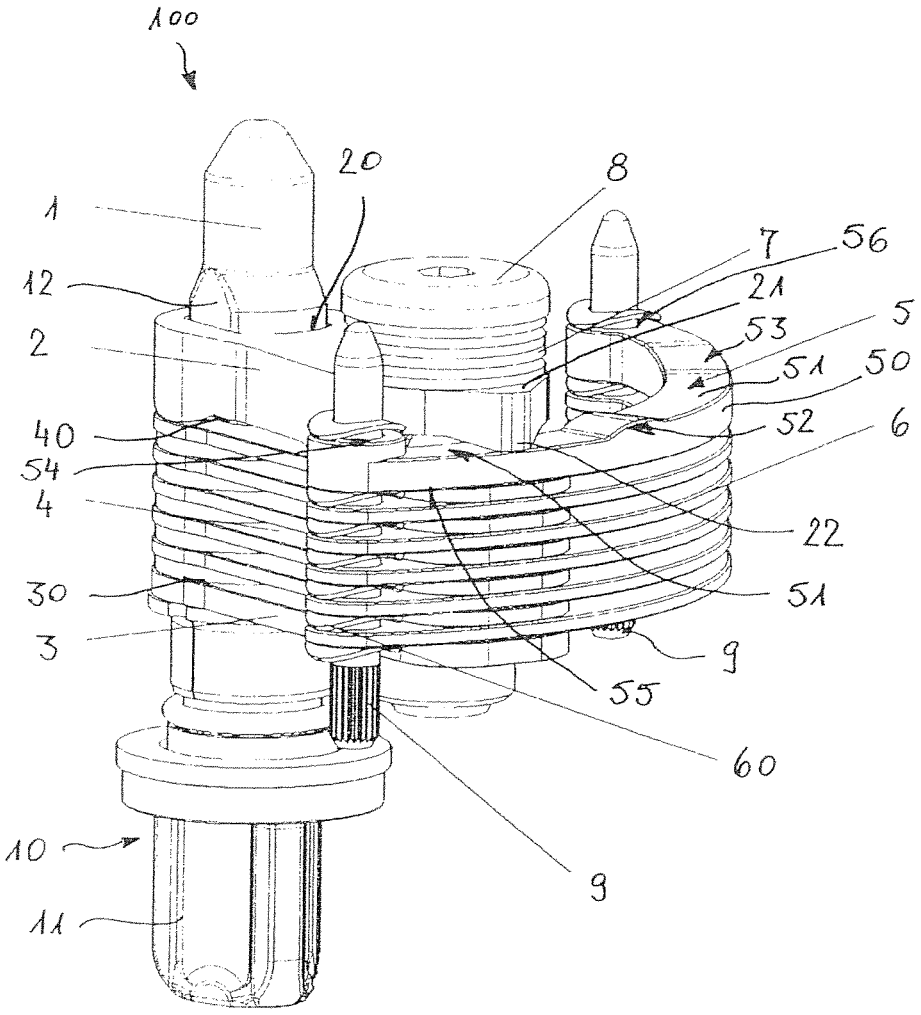
FIG. 2 shows a perspective view of only the door hinge according to FIG. 1.

According to FIGS. 1 and 2, the door hinge 100 furthermore comprises two holding arms 2, 3 that are arranged on top of one another along the hinge axis 1 Retaining disks 4 are arranged between these holding arms. The two holding arms 2, 3, as well as the retaining disks 4, are connected to the hinge axis 1 by means of respective openings 20, 30 and 40 arranged on their ends. The openings 20, 30 and 40 are respectively shaped unevenly in order to prevent the holding arms 2, 3 and the retaining disks 4 from inadvertently turning about a hinge axis 1. The hinge axis 1 likewise has an uneven profile. According to FIGS. 1 and 2, the hinge axis 1 is flattened on one side in this case, i.e. it features a flattened section 12. In this way, the holding arms 2, 3 and the retaining disks 4 are non-rotatably held on the hinge axis 1. These components therefore form one hinge part. In order to optimally position the holding arms 2, 3 and the retaining disks on the hinge axis 1, they are furthermore arranged on and connected to the hinge axis 1 in an axially displaceable fashion.

The holding arm 2 features a spherical section 22 on its end 21 that lies opposite of the end with the opening 20. The holding arm 2 rests against a contour 5 formed on the outer side of a contour element 50 with this spherical section. The contour element 50 has the shape of a circular arc. The contour 5 comprises planar surfaces 51, an elevation 52 (referred to the plane of the planar surfaces 51) and a depression 53 (referred to the plane of the planar surfaces 51). Brake disks 6 are provided adjacent to and in alignment with the circular arc-shaped contour element 50. These brake disks likewise have the shape of a circular arc. In this arrangement of the door hinge 100 in space or in the installed state of the door hinge 100 illustrated in FIGS. 1 and 2, these brake disks are arranged underneath the contour element 50 on its side 55 that lies opposite of the contour 5. The brake disks 6 and the contour element 50 form a second hinge part. They are fixed in their position relative to one another on their ends by means of two pin elements 9 and supported on these pin elements 9. The contour element 50 and the brake disks 6 respectively feature openings on their ends in order to be supported on the pin elements 9, but only the openings 54 and 56 in the contour element 50 are visible in FIG. 2. Disk springs 60 are provided between the brake disks 6 and between the brake disks 6 and the contour element 50, as well as on the upper side thereof, in order to realize an axial compensation along the pin elements 9 and to thereby position the individual brake disks 6 along the pin elements 9 free of play or essentially free of play. In this way, annoying noises during the operation can also be prevented and the thickness of the brake disks 6 can be compensated for the wear occurring over their service life. The contour element 50 and the brake disks 6 are mounted in the housing 101 of the door hinge 100 by means of the pin elements 9 as shown in FIG. 1. The two pin elements 9 are supported in corresponding bearing openings 102 in a lower part 103 of the housing 101. The door console 110 for being mounted on a not-shown door is arranged adjacent to one side of the housing 101 as already mentioned above. The hinge part or the assembly consisting of the contour element 50 with its contour 5 and the brake disks 6 can be moved relative to the hinge part or assembly consisting of the holding arms 2, 3 and the retaining disks 4 about the hinge axis 1.

The retaining disks 4 and the brake disks 6 respectively engage into one another or mesh with one another as illustrated particularly well in FIG. 2. The spherical section 22 of the first holding arm 22 is supported on the contour 5 and the second holding arm 3 engages underneath the bottom brake disk 6, i.e. the brake disk 6 that is spaced apart from the contour element 50 by the greatest distance, adjacent to the second holding arm 3. A device for generating a basic clamping force, in this example a disk spring assembly 7, is provided in order to ensure that the assemblies consisting of the holding arms 2, 3 and retaining disks 4 arranged in between on the one hand and of the contour element 50 and brake disks 6 arranged adjacent thereto on the other hand are held on one another by a clamping force. Alternatively, it would also be possible to provide a different type of spring assembly or another device, e.g. a pneumatic device, which is likewise capable of exerting a basic clamping force upon the first holding arm 2, the contour element 50, the retaining disks 4, the brake disks 6 and the second holding arm 3.

A set screw 8 is provided for adjusting the basic clamping force of the disk spring assembly 7. A different device for adjusting the basic clamping force can be used if another device for generating the basic clamping force is provided. According to FIG. 2, in particular, the disk spring assembly 7 with the set screw 8 arranged on top thereof is positioned on the end of the holding arms 2, 3 and the retaining disks 4, on which they engage on the contour 5 of the contour element 50 and the brake disks 6, i.e. near the contact region between the holding arm 2, the contour 5, the retaining disks 4, the brake disks 6 and the holding arm 3, in order to optimally exert the basic clamping force upon these components of the door hinge 100.

A holding torque of the door or the door hinge 100 is generated by respectively clamping the holding arms 2, 3 and the retaining disks 4 on or against the contour 5 of the contour element 50 and the brake disks 6, wherein the spherical section 22 of the holding arm 2 resting on the contour 5, as well as the disk spring assembly 7, are respectively arranged distant from the hinge axis 1 on the respective end of the holding arm 2 or the retaining disks 4, which lie opposite of the connection to the hinge axis 1.

When the door connected to the door console 110 is moved, i.e. opened or closed, the spherical section 22 of the first holding arm 22 moves or passes over the contour 5 and accordingly its planar surfaces 51, elevation(s) 52 and, if applicable, depression(s) 53. During this process, the holding torque changes in dependence on the opening angle of the door because the disk spring assembly 7 is compressed to different degrees by the first holding arm 2 due to the different height levels of the contour 5. This also changes the resulting clamping force, by means of which the retaining disks 4 and the brake disks 6 are pressed on or against one another. Different regions of the door hinge can thereby be defined. For example, a free-running region, which serves for closing the door, can be generated when a low clamping force or no clamping force is generated. A high clamping force may be generated in a retaining region such that the door can also be securely held on a hill. An average clamping force may be generated in a comfort region and serve for holding the door on level ground. In a damping region, a continuously increasing clamping force may be generated prior to reaching a final position (with high clamping force), wherein this is realized by providing a ramp on the contour 5 before the elevation 52 is reached.

The surfaces of the components of the door hinge 100 that rest and slide on one another, i.e. the spherical section 22 of the holding arm 2, the contour 5, the retaining disks 4, the brake disks 6 and the holding arm 3, can be better protected against wear and their sliding properties can be improved if at least these surfaces or surface sections or these complete components are coated with a corresponding material and/or heat-treated. A suitable material may be sufficiently hard for preventing wear on the one hand and simplify a sliding movement on the other hand. A wear protection and an improvement of the sliding properties can both be realized with a heat treatment of the components or at least their active surfaces.

Due to the utilization of a plurality of retaining disks 4 and brake disks 6 that respectively engage into one another or mesh with one another, the clamping force required for generating a predefined holding torque can be significantly lowered in comparison with the solutions known from the prior art. The wear between the first holding arm 2 and the contour 5 can also be substantially reduced due to the reduced stress on the retaining disks 4 and the brake disks 6 resulting from the comparatively lower clamping force such that the service life of the door hinge 100 can be significantly prolonged in comparison with known door hinges.

The haptics of the door hinge 100, which are dependent on the opening angle, can be varied depending on the design of the contour 5, i.e. the arrangement and configuration of the planar surfaces 51, the elevations 52 and the depressions 53. The properties of the door hinge 100 and the above-described regions with a low up to a high clamping force or a free-running region, a retaining region, a comfort region and a damping region, can be varied by changing the contour 5, i.e. by replacing the contour element with another contour element 50 that has a different contour 5, and/or by changing the number of retaining disks 4 and brake disks 6. Such a variation is simplified due to the modular design of the door hinge 100, in which all components, particularly the retaining disks 4, the brake disks 6 and the contour element 50 with the contour 5, but also the at least two holding arms 2, 3, can be easily replaced with other components and their number and arrangement can be varied.

Instead of the axial arrangement of the retaining disks 4 and brake disks 6 (on top of one another) illustrated in FIGS. 1 and 2, these disks may also be arranged radially. Instead of using one pair of holding arms with the holding arms 2, 3, it is also possible to provide multiple pairs of holding arms and/or the pair of holding arms may in contrast to FIGS. 1 and 2 be arranged in a star-shaped fashion.

The available structural space in the region of the door console 110 and the column console 120 can be optimally utilized due to the circular arc-shaped design of the contour element 50 in the form of a circular arc element and the brake disks 6. FIG. 1, in particular, shows that a clearance remains between the hinge axis 1 and the column console 120 such that the distance between the door axis and the outer shell of the vehicle can be very small.

In addition to the above-described and illustrated embodiments of door hinges for connecting and pivoting a door relative to a column console, which comprise at least one hinge axis, at least one holding arm that engages on the hinge axis and at least one contour and in which the at least one holding arm is supported on the contour with at least one section, it is furthermore possible to implement numerous other embodiments, particularly also any combinations of the described characteristics, in which retaining disks are respectively provided adjacent to the at least one holding arm and brake disks are provided adjacent to the contour in order to generate a holding torque that is dependent on the opening angle of the door, which is or can be connected to the door hinge, during a pivoting movement thereof, wherein the retaining disks and the brake disks engage into one another and at least the first holding arm, which is supported on the contour, is stressed at least relative to the contour by means of a basic clamping force, and wherein said basic clamping force holds the assemblies consisting of the holding arms and retaining disks and of the contour element and the brake disks on one another such that the holding arm follows the contour while it passes over this contour.

REFERENCE LIST

1 Hinge axis
2 Holding arm
3 Holding arm
4 Retaining disk
5 Contour
6 Brake disk
7 Disk spring assembly
8 Set screw
9 Pin element
10 Lower end of 1
11 Bearing pin
12 Flattened section
20 Opening
21 End
22 Spherical section
30 Opening
40 Opening
50 Contour element
51 Planar surface
52 Elevation
53 Depression
54 Opening
55 Side of 50
56 Opening
60 Disk spring
100 Door hinge
101 Housing
102 Bearing opening
103 Lower part of 101
110 Door console
111 Mounting opening
120 Column console
121 Mounting arm
122 Mounting opening

What is claimed is:

1. A door hinge for being connected to a door by a door console of the door hinge that can be pivoted relative to a column console of the door hinge for being connected to a vehicle body, comprising: at least one hinge axis, at least one holding arm that engages on the hinge axis and at least one contour, wherein the at least one holding arm is supported on the contour with at least one section of the at least one holding arm, wherein retaining disks are arranged adjacent to the at least one holding arm and brake disks are arranged adjacent to the contour in order to generate a holding torque that is dependent on the opening angle of the door, which is or can be connected to the door hinge, during a pivoting movement thereof, wherein the retaining disks and the brake disks engage into one another, the at least one contour is formed on an outer side of at least one contour element, the brake disks and the contour element have the shape of a circular arc and the at least one holding arm and the retaining disks are non-rotatably held on the hinge axis, wherein a first assembly consisting of the contour element with its contour and the brake disks can be moved relative to a second assembly consisting of the at least one holding arm and the retaining disks about the hinge axis, wherein the first assembly is operatively linked to the door console and the second assembly is operatively linked to the column console, and wherein at least the first holding arm, which is supported on the contour, is or can be stressed at least relative to the contour by a basic clamping force, provided by a device that presses the at least one holding arm, the contour, the retaining disks and the brake disks against one another; in order to hold the assemblies consisting of the holding arms and the retaining disks and of the contour element and the brake disks on one another such that the holding arm follows the contour while it passes over this contour.

2. The door hinge according to claim 1, wherein the curvature of the contour element and the curvature of the brake disks geometrically correspond to one another.

3. The door hinge according to claim 2, wherein i) the contour element is arranged axially on top of and in alignment with the brake disks and/or ii) the brake disks and/or the retaining disks are arranged radially with respect to the orientation of the hinge axis of the door hinge, and wherein the at least one contour element provided with the contour and the brake disks are or can be held on one another by pin elements, wherein the contour element and the brake disks are mounted such that they can be axially displaced along the pin elements.

4. The door hinge according to claim 3, wherein disk springs are arranged between the brake disks in order to position the brake disks on top of one another free of play.

5. The door hinge according to claim 4, wherein the at least one holding arm and the retaining disks are mounted such that they can be axially displaced along the hinge axis, and wherein the device that presses the at least one holding arm, the contour, the retaining disks and the brake disks against one another is at least one spring assembly.

6. The door hinge according to claim 4, wherein at least one adjusting device, particularly at least one set screw that acts upon the spring assembly, especially the disk spring assembly, is provided for adjusting the basic clamping force, and wherein the device that presses the at least one holding arm, the contour, the retaining disks and the brake disks against one another is at least one pneumatic and/or hydraulic and/or electric device.

7. The door hinge according to claim 6, wherein at least surfaces or surface sections of the holding arm or holding arms, the retaining disks, the brake disks and the contour of the contour element, which rest and/or slide on one another, are provided with at least one coating and/or heat-treated in order to influence their sliding properties and/or wear behavior, wherein multiple holding arms are provided or a star-shaped holding arm arrangement is provided, and wherein the door hinge has a housing, the housing being connectable to the door console, wherein only one holding arm is provided and exerts pressure upon the retaining disks and the brake disks via the contour of the contour element, wherein the retaining disk or brake disk, which is spaced apart from the holding arm by the greatest distance, is supported on a lower part of a housing of the door hinge, in which these disks are accommodated.

8. A vehicle, particularly a motor vehicle, with at least one door hinge according to claim 7, wherein the door hinge is arranged in a region of a door console and a column console.

9. The door hinge according to claim 1, wherein i) the contour element is arranged axially on top of and in alignment with the brake disks and/or ii) the brake disks and/or the retaining disks are arranged radially with respect to the orientation of the hinge axis of the door hinge.

10. The door hinge according to claim 1, wherein the at least one contour element provided with the contour and the brake disks are or can be held on one another by pin elements, wherein the contour element and the brake disks are mounted such that they can be axially displaced along the pin elements.

11. The door hinge according to claim 1, wherein disk springs are arranged between the brake disks in order to position the brake disks on top of one another free of play.

12. The door hinge according to claim 1, wherein the at least one holding arm and the retaining disks are mounted such that they can be axially displaced along the hinge axis.

13. The door hinge according to claim 1, wherein the device that presses the at least one holding arm, the contour, the retaining disks and the brake disks against one another is at least one spring assembly.

14. The door hinge according to claim 13, wherein at least one adjusting device, particularly at least one set screw that acts upon the spring assembly, especially the disk spring assembly, is provided for adjusting the basic clamping force.

15. The door hinge according to claim 1, wherein the device that presses the at least one holding arm, the contour, the retaining disks and the brake disks against one another is at least one pneumatic and/or hydraulic and/or electric device.

16. The door hinge according to claim 1, wherein at least surfaces or surface sections of the holding arm or holding arms, the retaining disks, the brake disks and the contour of the contour element, which rest and/or slide on one another, are provided with at least one coating and/or heat-treated in order to influence their sliding properties and/or wear behavior.

17. The door hinge according to claim 1, wherein multiple holding arms are provided or a star-shaped holding arm arrangement is provided.

18. The door hinge according to claim 1, wherein the door hinge has a housing, the housing being connectable to the door console, wherein only one holding arm is provided and exerts pressure upon the retaining disks and the brake disks via the contour of the contour element, wherein the retaining disk or brake disk, which is spaced apart from the holding arm by the greatest distance, is supported on a lower part of the housing of the door hinge, in which these disks are accommodated.

19. A vehicle, particularly a motor vehicle, with at least one door hinge according to claim 1, wherein the door hinge is arranged in a region of a door console and a column console.

* * * * *